US005573639A

United States Patent [19]

Schmitz et al.

[11] Patent Number: 5,573,639

[45] Date of Patent: Nov. 12, 1996

[54] ANTIFALSIFICATION PAPER HAVING A THREAD- OR BAND-SHAPED SECURITY ELEMENT

[75] Inventors: Christian Schmitz, Fischbachau; Armin Weingartner, Pullach, both of Germany

[73] Assignee: Giesecke & Devrient GmbH, Munich, Germany

[21] Appl. No.: 358,153

[22] Filed: Dec. 16, 1994

[30] Foreign Application Priority Data

Dec. 23, 1993 [DE] Germany ..... 43 44 298.6

[51] Int. Cl.[6] ..... D21H 27/00; D21H 21/42; B44F 1/12

[52] U.S. Cl. ..... 162/140; 162/134; 162/104; 428/916

[58] Field of Search ..... 162/140, 103, 162/104, 134; 428/199, 916

[56] References Cited

U.S. PATENT DOCUMENTS

| | | | |
|---|---|---|---|
| 964,014 | 7/1910 | Gernaert | 162/140 X |
| 3,880,706 | 4/1975 | Williams | 162/103 |
| 4,437,935 | 3/1984 | Crane, Jr. | 162/103 |
| 4,534,398 | 8/1985 | Crane | 162/103 |
| 4,552,617 | 11/1985 | Crane | 162/103 |
| 4,761,205 | 8/1988 | Crane | 162/103 |

FOREIGN PATENT DOCUMENTS

| | | | |
|---|---|---|---|
| 059056 | 2/1982 | European Pat. Off. . | |
| 279880 | 8/1988 | European Pat. Off. . | |
| 330733 | 9/1989 | European Pat. Off. . | |
| 0518740A1 | 12/1992 | European Pat. Off. | D21H 21/42 |
| 2250473 | 6/1992 | United Kingdom | D21H 21/42 |

*Primary Examiner*—Donald E. Czaja
*Assistant Examiner*—Jose A. Fortuna
*Attorney, Agent, or Firm*—Hazel & Thomas

[57] ABSTRACT

The invention relates to an antifalsification paper having a security element in the form of a thread or band which consists of a transparent plastic film with an at least partly opaque coating. The security element has at least a first opaque coating and a transparent area bordering on this opaque coating, and information extending from the first opaque coating into the transparent area.

16 Claims, 3 Drawing Sheets

ANTIFALSIFICATION PAPER HAVING A THREAD- OR BAND-SHAPED SECURITY ELEMENT

BACKGROUND OF THE INVENTION

The present invention relates to an antifalsification paper having a security element in the form of a thread or band which consists of a transparent plastic film with an at least partly opaque coating and bears information in the form of visually and/or machine readable characters or patterns.

Bank notes and other monetary papers such as checks, shares, traveler's checks, check and credit cards, as well as passports and identity cards are frequently protected from forgery by the insertion or application of so-called safeguarding threads. Papers of this type will be referred to in the following as antifalsification papers. The safeguarding threads used for this purpose are made of a great variety of materials in the form of threads or bands with a width of 0.4 to 10 millimeters. They predominantly consist of plastic films which are metal-coated, printed, dyed or provided e.g. with pigment substances. Furthermore it is also known to give safeguarding threads magnetic, fluorescent, X-ray absorptive and other properties by selecting corresponding substances.

Metal-coated threads have recently been used increasingly for antifalsification papers. These threads, which are disposed partly or wholly within the paper, are almost invisible in incident light. This is because the light rays penetrating the upper paper layer are completely reflected on the metallic surface and scattered diffusely within the paper. In transmitted light, on the other hand, such threads appear as black stripes clearly standing out from their surroundings. Threads of this type cannot be imitated by a print on the paper. To increase the resistance to forgery it has also been proposed that such aluminized safeguarding threads be provided with microwriting (DE-A 14 46 851). However this has proved to be rather impractical since the writing is not recognizable on the otherwise opaque safeguarding thread in transmitted light and very difficult to recognize in incident light. Even when such safeguarding threads are incorporated in the paper as so-called window threads, as described in EP-C 0 059 056, the microprint remains difficult to find in the printed paper.

EP-A 0 279 880 discloses a safeguarding thread made of transparent film material on which metallically lustrous microcharacters are provided. The microcharacters are not recognizable in incident light since the thread is completely embedded within the bank note. In transmitted light, on the other hand, only the characters are recognizable since the safeguarding thread itself is of transparent design. The viewer thus sees in transmitted light only some writing running through the bank note that is difficult to find due to the smallness of the characters, their embedding in the paper stuff and a printed image possibly located thereabove. On the other hand, the small size of the microcharacters makes it difficult to imitate such a thread.

In a further safeguarding thread known from EP-A 0 330 733, a transparent plastic film, which can be colored, is provided with an all-over, opaque, in particular metallic, coating in which gaps in the form of characters or patterns are produced. The thread is recognizable in the document in transmitted light as a dark stripe, while the characters and patterns stand out in readily recognizable fashion as light, possibly colored surfaces from their immediate surroundings, the opaque thread coating, and additionally from their more removed surroundings, the document material. The thread is thus very easy to find in the document and the characters are also readable at any time without aid if they are large enough.

When such a thread is incorporated in an antifalsification paper as a window thread it offers additional copy protection in the area of the windows since the metallic luster of the coating cannot be reproduced by a copying machine and the copy therefore renders these areas in black.

SUMMARY OF THE INVENTION

The invention is based on the problem of producing an antifalsification paper having a thread- or band-shaped security element that offers a high level of protection against forgery while simultaneously ensuring good recognizability of the security element and the characters without requiring the use of any technical aids. This problem is solved by the features characterizing the present invention will be discussed below.

In a preferred embodiment the antifalsification paper of the present invention has a safeguarding thread comprising a transparent plastic substrate with a screenlike metal coating. This may be for example a periodic striped pattern which can assume any orientation with respect to the running direction of the thread. In addition, this safeguarding thread bears, in particular, visually readable information extending over several opaque, metallic areas and metal-free intermediate areas. That is, the information, which can include any characters or patterns, is present in the form of transparent metal-free areas.

This screenlike arrangement of the metal areas has the advantage that the frequent metal/nonmetal alternation makes it possible to imitate the visual impression, if at all, only by means of elaborate techniques.

As an alternative to the completely transparent representation of the information, the characters and/or patterns can also be composed of alternatingly disposed opaque and transparent areas. In this case the transparent information portions are located in the area of the opaque background coating and the opaque information portions in the coating-free transparent intermediate areas, so that the information stands out in contrast from the background pattern. This form of representation also results in frequent metal/nonmeal alternations whose arrangement in exact register can only be imitated with elaborate techniques.

In the paper the inventive security element, like all metalized safeguarding threads, offers good copy protection due to the well-known incident light/transmitted light effect. Large contiguous metallic areas appear in incident light as dark places in the paper, so that there were already attempts to imitate this visual impression with known security elements. Small metallic areas, like the metallic characters described in EP-A 0 279 880, are less perceptible in incident light, but are also difficult to find in transmitted light. As a result, it is difficult to check this authenticity feature. The inventive security element, by contrast, is easy to find and to check in the paper due to the background pattern comprising about 50% of the opaque areas. Moreover, the screenlike arrangement of the opaque areas and the resulting frequent alternations between opaque and nonopaque areas prevent, or at least greatly obstruct, imitations of the visual impression in incident light.

Further advantageous embodiments will be explained with reference to the Figures. For better clarity the representation in the figures is not true to scale or to proportion.

DETAILED DESCRIPTION OF THE PREFERRED EMBODIMENTS

Figure 1:
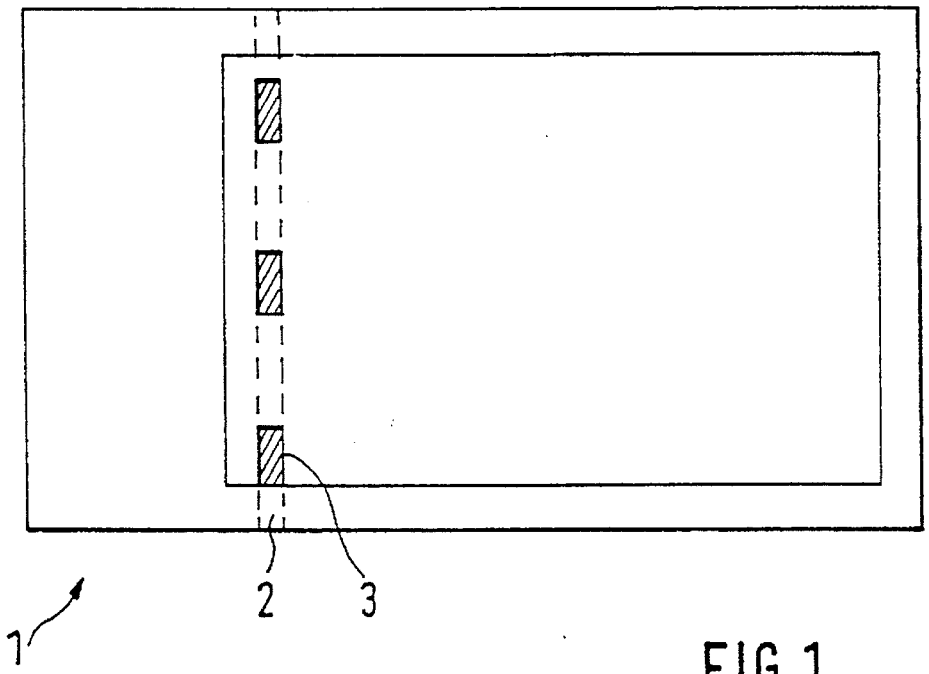
FIG. 1 shows a security document according to the present invention.

FIG. 1 shows a security document according to the present invention. In this first embodiment, the security document is embodied in a bank note, in which a thread- or band-shaped security element 2 is woven in the form of a window thread so that the thread passes directly to the paper surface at certain intervals or windows 3. However the thread can also be embedded completely in the paper or be designed to lie entirely on the outside. The width of the thread can be for example between 0.4 and 10 millimeters.

The special embodiments the of security element 2 will be explained in more detail hereinbelow with reference to FIGS. 2 to 8. These figures each show details of an inventive security element in plan view.

Figure 2:
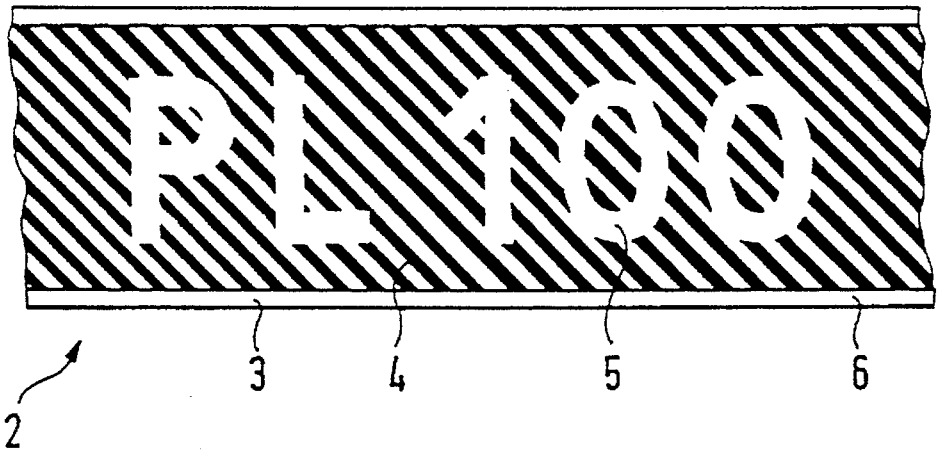
FIGS. 2 to 8 show various embodiments of the security element according to the present invention.

The embodiment shown in FIG. 2 comprises a transparent or at least translucent plastic substrate 3 provided with striped metalization 4. Visually and/or machine readable information 5 extends over several such stripes, standing out from this background due to the accordingly shaped gaps in the opaque stripes. Metallic stripes 4 can have, for example, a width of 200 microns and a 45° inclined orientation with respect to the running direction of the thread, while the type thickness of the contrasting information can be 600 microns. The example shown in FIG. 2 has a coating-free edge area 6 which serves as a cutting tolerance during production of the threads in web form and, in particular, ensures a uniform appearance of the thread in the window area when it is incorporated as a window thread. Edge area 6 can be dispensed with in the production of completely exposed or embedded threads.

Figure 3:
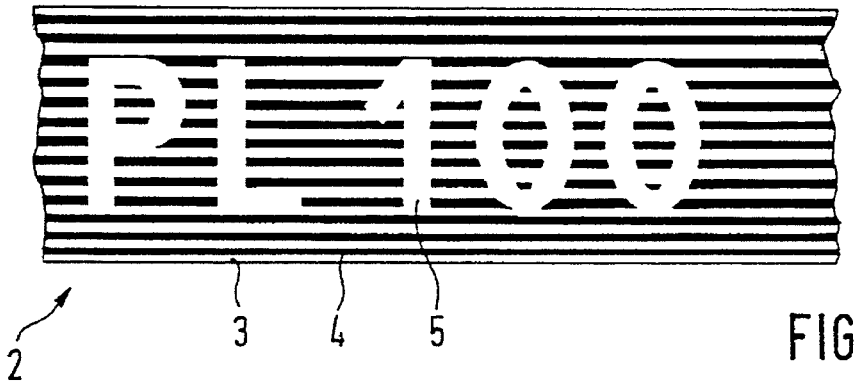

The orientation of the metallic stripes can be selected at will and is 0° with respect to the running direction of the thread in a further preferred embodiment, as FIG. 3 shows. The same holds of course for the selected stripe widths and type thicknesses.

Also, the background pattern need not necessarily be striped but can also involve any other screenlike metal arrangement, e.g. a dot screen or a screen of geometrical figures of any shape. One should only make sure that the extent of the metal areas and the type size of the information are coordinated with each other in such a way that the information contrasts with the background and is thus recognizable.

According to a further embodiment of the invention, the information can also be composed of opaque and transparent areas that stand out from their particular surroundings. Such variants are shown in FIGS. 4 to 8.

Figure 4:
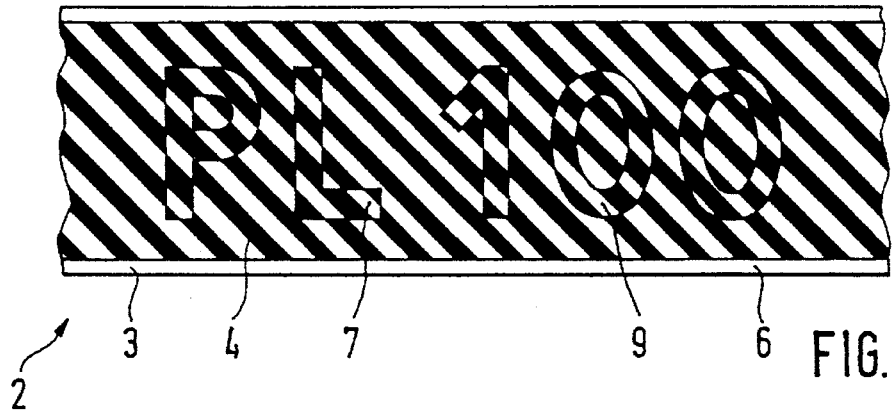

FIG. 4 shows a similar background pattern to FIG. 2, i.e. opaque metal stripes inclined 45° to the running direction of the thread, with a width of 400 microns and accordingly shaped gaps 9 in the area of the characters. Inversely, information portions 7 located in the coating-free intermediate areas are given an opaque coating that is likewise striped and has the same angular orientation.

Figure 5:
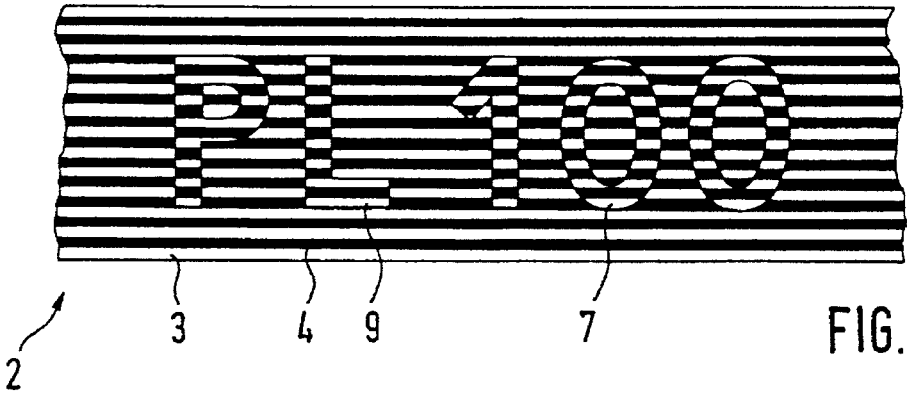

FIG. 5 shows the analogous case for a striped background pattern extending parallel to the running direction of the thread.

Figure 6:
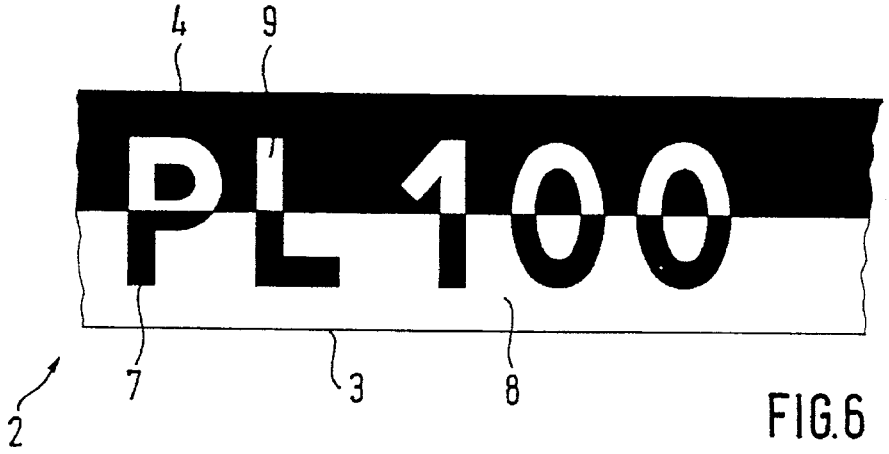

Another alternative is shown in FIG. 6. In this case plastic substrate 3 is divided into two areas disposed parallel to the running direction of the thread. The upper area includes metalization 4 in which transparent portions 9 of the information are provided. Opaque information portions 7 are located in lower coating-free area 8 of plastic substrate 3.

Figure 7:
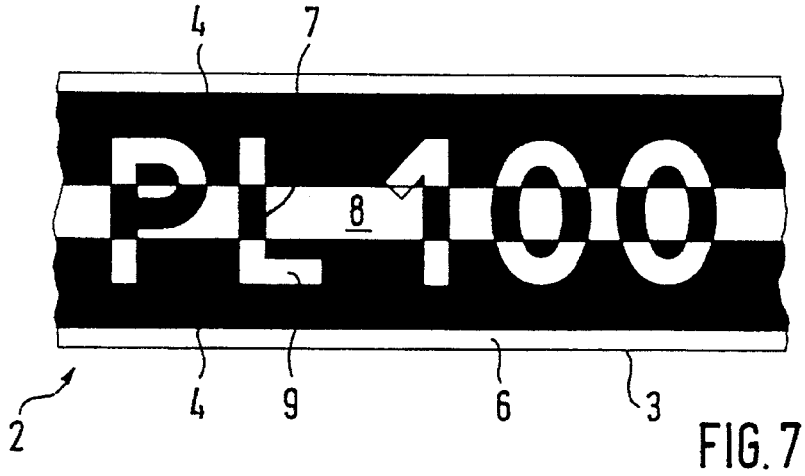

A further variation is offered in FIG. 7. Here, plastic substrate 3 is provided with two metal stripes 4 extending along the thread symmetrically to the center of the thread and having e.g. a width of about 1.3 millimeters. These stripes are separated from each other by coating-free area 8 about 1 millimeter wide. The information superimposed on this background pattern has a type size of about 3 millimeters, a type thickness of 600 microns and extends over all three background areas. In metal bars 4, the information portions are shown in the form of gaps 9, while portions 7 located in coating-free area 8 consist of opaque coating material.

Figure 8:
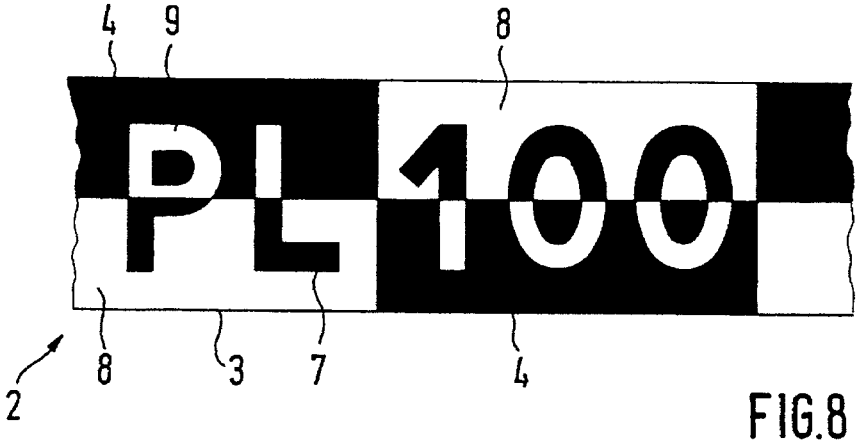

FIG. 8 shows a further embodiment of the composite information against a partly metalized background. In this case, the background is formed of metallic bars 4 disposed in checkered arrangement on plastic substrate 3. The readable information is composed of gaps 9 and metallic areas 7 as in the above-described variants and extends over at least one pair of adjacent metallic/metal-free areas, regarded in the transverse direction of the thread.

It is of course possible to design metalized information portions 7 and metallic background areas 4 with various metals of different inherent colors. Quite generally, one can also use, instead of a metalization or metallic ink, other nonmetallic layers contrasting with the surroundings in terms of color and/or gray tone when viewed in transmitted light, e.g. opaque, preferably white, color layers, metallically lustrous layers such as titanium nitride or interference layers. Inks containing interference pigments are also conceivable.

The plastic substrate can also be provided with nonopaque, preferably transparent, inks in various colors and tints. However the film can also be dyed with suitable colorants in such a way that the transparency is maintained in a partial area of the visually accessible spectrum. Luminescent inks can be used to improve the visual impression of this thread even further and make it more effective. The luminescent inks can either be colorless in the nonexcited state or have a body color that preferably differs from the color of the emitted light. The characters or patterns then only appear colored in the excitation light or change their color when the thread is viewed e.g. under UV light. Several luminescent substances emitting in different colors increase both the possibilities of design and the resistance to forgery since each individual luminescent substance must be analyzed for exact imitation. This analysis can easily be made even more difficult by mixing the various luminescent inks or printing them on in an overlapping arrangement.

The described thread variants can be produced, if no inks are used, by a washing process or another demetalizing method, as described e.g. in EP-A 0 330 733, to which reference is explicitly made in this connection.

Although the present invention has been fully described in connection with the preferred embodiments thereof with reference to the accompanying drawings, it is to be noted that various changes and modifications are apparent to those skilled in the art. These and other changes and modifications are to be understood as included within the scope of the present invention as defined by the appended claims, unless they depart therefrom.

We claim:

1. An antifalsification paper having at least one security element in the form of threads or bands, said antifalsification paper comprising:

at least one transparent plastic film portion;

an at least partly opaque coating formed on said transparent plastic film portion defining at least one opaque coating area adjacent to and alternatingly disposed with at least one transparent area; and visually or machine readable characters or patterns for displaying information to be conveyed by said security element, wherein said visually or machine readable characters or patterns are formed on and defined by said adjacent and alternatingly disposed opaque coating and transparent areas whereby said characters or patterns extend from said opaque areas into said transparent areas.

2. The antifalsification paper of claim 1 wherein said characters or patterns are defined in said opaque area in the form of gaps in said opaque area.

3. The antifalsification paper of claim 1 wherein said opaque coating area is formed from a metallization or a metallic-looking ink.

4. The antifalsification paper of claim 1 wherein said at least partly opaque coating defines said adjacent and alternatingly disposed opaque coating and transparent areas including transparent areas bordering on said opaque coating areas.

5. The antifalsification paper of claim 1 wherein said opaque coating area is a periodic screen from a geometrical figure and said transparent area is formed by space free of said opaque coating area.

6. The antifalsification paper of claim 5 wherein said at least partly opaque coating defines a plurality of opaque coating areas alternatingly disposed with a plurality of transparent areas, said opaque coating areas forming a repeating striped pattern disposed at a predetermined angle to a running direction of said security element.

7. The antifalsification paper of claim 6 wherein said stripped pattern extends at an angle of 0° or 45°.

8. The antifalsification paper of claim 1 wherein said at least partly opaque coating defines a plurality of opaque coating areas adjacent to and alternatingly disposed with a plurality of transparent areas, said opaque coating areas including a first portion formed from a first opaque coating and a second portion formed from a second opaque coating.

9. The antifalsification paper of claim 8 wherein said second portion of opaque areas formed from said second opaque coating has the same screen pattern and the same orientation as said first opaque coating.

10. The antifalsification paper of claim 8 wherein said first portion of opaque areas formed from said first opaque coating is a stripe extending parallel to the running direction of said security element.

11. The antifalsification paper of claim 8 wherein said first portion of opaque coating areas formed from said first opaque coating comprises two areas disposed parallel to a running direction of said security element and separated by said transparent areas likewise disposed parallel to said running direction of said security element.

12. The antifalsification paper of claim 8 wherein said first portion of opaque coating areas formed from said first opaque coating and said transparent areas are formed as bars disposed in a checkered arrangement along a running direction of said security element.

13. The antifalsification paper of claim 8 wherein said second portion of opaque coating areas formed from said second opaque coating has a different inherent color from said first opaque color.

14. The antifalsification paper of claim 8 wherein said second portion of opaque coating areas formed from said second opaque coating is a metallization or a metallic-looking ink.

15. A security element to be embedded in an antifalsification paper in the form of a thread or band, said security element comprising:

a transparent plastic film; an at least partly opaque coating formed on said transparent plastic film defining at least one opaque coating area adjacent to and alternatingly disposed with at least one transparent area; and visually or machine readable characters or patterns for bearing information to be displayed by said security element, wherein said visually or machine readable characters or patterns are formed on and defined by said adjacent and alternatingly disposed opaque coating and transparent areas whereby said characters or patterns extend from said opaque areas into said transparent areas.

16. A security element of claim 15 wherein said at least partly opaque coating defines said adjacent and alternatingly disposed opaque coating and transparent areas including transparent areas bordering on said opaque coating areas.

* * * * *